US010161069B2

(12) United States Patent
Astadourian et al.

(10) Patent No.: US 10,161,069 B2
(45) Date of Patent: Dec. 25, 2018

(54) STUFFERS FOR PURSES, BOOTS AND THE LIKE

(71) Applicant: I'M OUT!, INC., Los Angeles, CA (US)

(72) Inventors: Mary Astadourian, Santa Monica, CA (US); Jennifer Dynof, Los Angeles, CA (US)

(73) Assignee: I'M OUT!, INC., Los Angeles, CA (US)

( * ) Notice: Subject to any disclaimer, the term of this patent is extended or adjusted under 35 U.S.C. 154(b) by 264 days.

(21) Appl. No.: 15/295,805

(22) Filed: Oct. 17, 2016

(65) Prior Publication Data

US 2017/0029996 A1 Feb. 2, 2017

Related U.S. Application Data

(63) Continuation-in-part of application No. 12/930,257, filed on Dec. 30, 2010.

(60) Provisional application No. 61/335,066, filed on Dec. 31, 2009.

(51) Int. Cl.

| | |
|---|---|
| ***A45C 13/04*** | (2006.01) |
| ***D05C 17/00*** | (2006.01) |
| ***A43B 23/02*** | (2006.01) |
| ***A43B 23/07*** | (2006.01) |
| *A45C 13/00* | (2006.01) |

(52) U.S. Cl.

CPC ..... *D05C 17/00* (2013.01); *A43B 23/025* (2013.01); *A43B 23/0235* (2013.01); *A43B 23/07* (2013.01); *A45C 13/004* (2013.01); *Y10T 428/2419* (2015.01); *Y10T 428/24033* (2015.01)

(58) Field of Classification Search

CPC ..... Y10T 428/24033; Y10T 428/2419; A45C 13/004; B65D 33/007

See application file for complete search history.

(56) References Cited

U.S. PATENT DOCUMENTS

| | | | |
|---|---|---|---|
| 2,464,859 | A | 3/1949 | Gilowitz |
| 3,200,427 | A | 8/1965 | Daley |
| 4,497,080 | A | 2/1985 | Inspector |
| 4,771,553 | A | 9/1988 | Smithdeal |
| 6,378,224 | B1 | 4/2002 | Qualkinbush et al. |
| 8,336,145 | B2 | 12/2012 | Dever et al. |
| 2010/0115713 | A1 | 5/2010 | Kurita et al. |
| 2010/0186259 | A1 | 7/2010 | Garza |

OTHER PUBLICATIONS

Essential Oils Handbook, 2003, National Institute of Industrial Research, p. 573.

*Primary Examiner* — Alexander S Thomas
(74) *Attorney, Agent, or Firm* — Kelly & Kelly, LLP

(57) ABSTRACT

A stuffer for clothing articles such as bags and purses is disclosed. One embodiment the purse stuffer is a sheet of an elegant, double quilted fabric that is stitched together to form a foldable stuffer. In one embodiment, the stuffer may be folded along one or more perpendicular folding stitch lines. In another embodiment, the stuffer may be folded along one or more, preferably four, parallel folding stitch lines. The stitch lines and the folding along increases the effect of the padding so as to form stuffers of varying sizes and shapes with a single construction. The various embodiments may be manufactured in different sizes to accommodate different size purses or bags.

14 Claims, 7 Drawing Sheets

STUFFERS FOR PURSES, BOOTS AND THE LIKE

RELATED APPLICATIONS

This application is a continuation-in-part of U.S. application Ser. No. 12/930,257, filed Dec. 30, 2010 now abandoned by one or more of the present inventors, which claimed the benefit of U.S. Provisional Application No. 61/335,066, filed Dec. 31, 2009 by one or more of the present inventors.

TECHNICAL FIELD

The present invention relates generally to stuffers of purses, boots, and the like. More particularly the present invention relates to stuffers that are simple to make and have an elegant appearance and a pleasant fragrance.

BACKGROUND OF THE DISCLOSURE

Stuffers for apparel items such as purses, shoulder bags, and boots are widely used. They serve several purposes. First, they retain the preferred shape of the apparel item during storage, thereby extending the life of the item. Second, they give the apparel a pleasant appearance during storage or when commercially displayed, appealing to a woman who has paid or is willing to pay several hundred dollars to purchase the item. Third, they help organize a home closet or a shelf in a commercial establishment so that the items may be displayed nicely in a row, rather than appearing haphazardly.

Various prior art patent documents and commercial products provide stuffer designs. The most common stuffer is the simplest: a piece of foam, Styrofoam, crunched tissue paper, or a towel. Some stuffer products provided commercially are designed to be produced as cheaply as possible, yet preserve the preferred shape of the items during shipment or commercial display. Typically, they are discarded once the item is purchased. Another type of prior art stuffer is designed so they collapse when not in use, and expand when inserted in the purse or other item. Often they have complex implementations that include springs and collapsible frames. Still another type of prior art stuffers are high-end products that provide multiple functions such as absorbing moisture and providing a pleasant scent.

Accordingly, there is a need for a simple stuffer that may preserve the preferred shape of a purse, shoulder bag, or boot, offers an attractive appearance when used with an expensive item, is relatively simple to manufacture, and appeals to the woman with elegant taste. The present invention fulfills these needs and provides other related advantages.

SUMMARY OF THE INVENTION

A first embodiment of the present invention is a simple but elegant purse stuffer. It is comprised of two major components, a member comprised of a quilted component that is shaped so it fits in the purse that it is designed for, and a sachet that contains a scented material. Various versions of the present invention may be implemented so they fit in purses of various dimensions. The present invention, when inserted into a purse, preserves the preferred shape of the purse, and when removed from the purse, preserves the purse's place in the user's closet. The simplicity and elegance of the present invention fits the needs and desires of the woman who uses it. A second embodiment applies the same inventive concept to boot stuffers. A preferred fabric is a quilted polyester silk charmeuse.

Third and fourth embodiments of the present invention relates to a stuffer for filling an internal cavity of a bag having a preferred shape. In these embodiments, the stuffer has a generally rectangular sheet of quilted fabric that is folded in half along a mid-line of the generally rectangular shape so as to form overlapping upper and lower sections. Adjacent edges of the upper and lower sections are stitched together so as to form a generally rectangular sheet of double quilted fabric enclosing an interior pocket. The interior pocket may or may not be filled with an apparel padding material.

A plurality of fold stitch lines are disposed across the sheet of double quilted fabric so as to join the upper and lower sections through the interior pocket. The sheet of double quilted fabric is preferably configured to approximate the preferred shape of the internal cavity of the bag. The sheet of double quilted fabric is foldable along one or more of the fold stitch lines to more closely approximate the preferred shape of the internal cavity of the bag.

In the third embodiment, the fold stitch lines may consist of a first fold stitch line and a second fold stitch line that are arranged orthogonally with respect to one another. Each of the first fold stitch line and the second fold stitch line may also be separately arranged orthogonally to one of the adjacent edges of the upper and lower sections. The first fold stitch line is disposed approximately at a mid-point of a length of the sheet of double quilted fabric and the second fold stitch line is disposed approximately at a mid-point of a width of the sheet of double quilted fabric.

In the fourth embodiment, the fold stitch lines may comprise at least four fold stitch lines that are arranged parallel with respect to one another and to at least one of the adjacent edges of the upper and lower sections. The four fold stitch lines divide the sheet of double quilted fabric into five parallel padding sections, wherein each padding section has a generally pointed oval cross-sectional shape. One or more of the padding sections are configured to overlap or abut when the sheet of double quilted fabric is folded alone one or more of the fold stitch lines.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

In the following detailed description, terms such as top, bottom, left, right, upper, lower, horizontal and vertical refer to the figure where each reference applies. The same numeral may be used to denote the same part in different views and in different embodiments. The term "internal cavity" of an apparel is used to refer to the interior space of a purse that holds its content, or the interior space of a boot where a user's leg fits. The "preferred shape" of an apparel having an internal cavity is the shape of the apparel when in normal use, e.g., the shape of a boot when being worn by a user or the shape of a purse when filled with user's items and being carried by the user.

Figure 1:
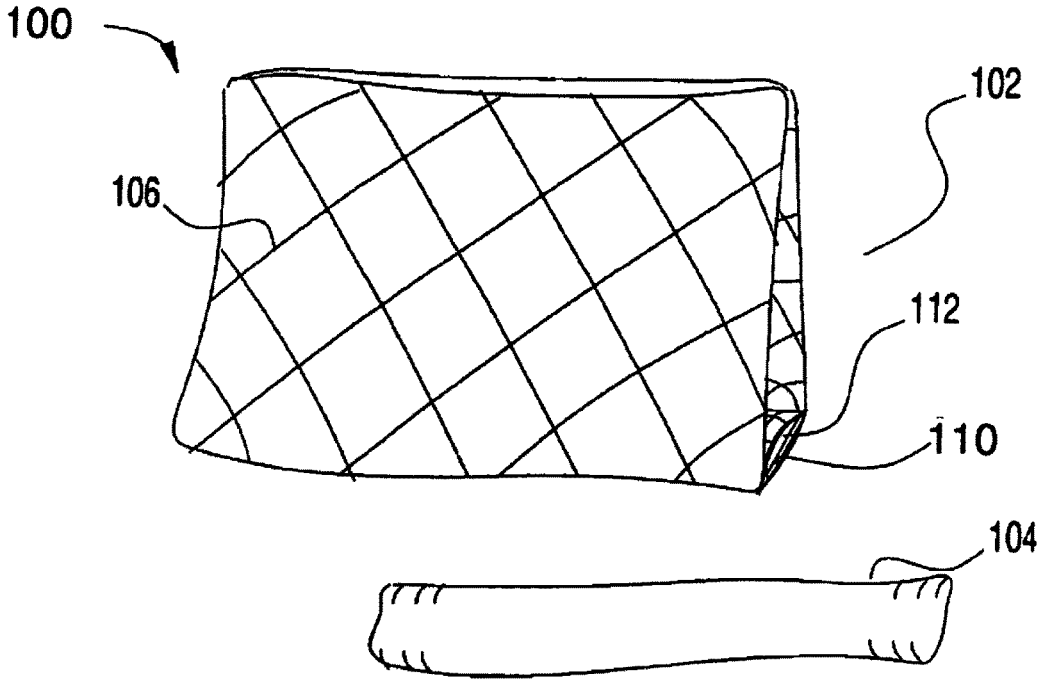
FIG. 1 is a front perspective view of the components of a purse stuffer comprising a first embodiment of the present invention.

FIG. 1 is a perspective view of the two components comprising a first embodiment 100 of the present invention. First embodiment 100 is comprised of a member comprised of a quilted purse stuffer 102 made out of a flexible, resilient fabric, preferably a quilted fabric, and a sachet 104. Quilted purse stuffer 102 has a pocket 112 with a hook/loop pair for opening and closing the pocket 112 that receives sachet 104. Note that only loop material 110 of hook/loop pair is visible in pocket 112. Sachet 104 contains an aromatic filler. The aromatic filler is not illustrated in FIG. 1. A preferred fabric is quilted polyester silk charmeuse, although other quilted fabric may be used.

Figure 2A:
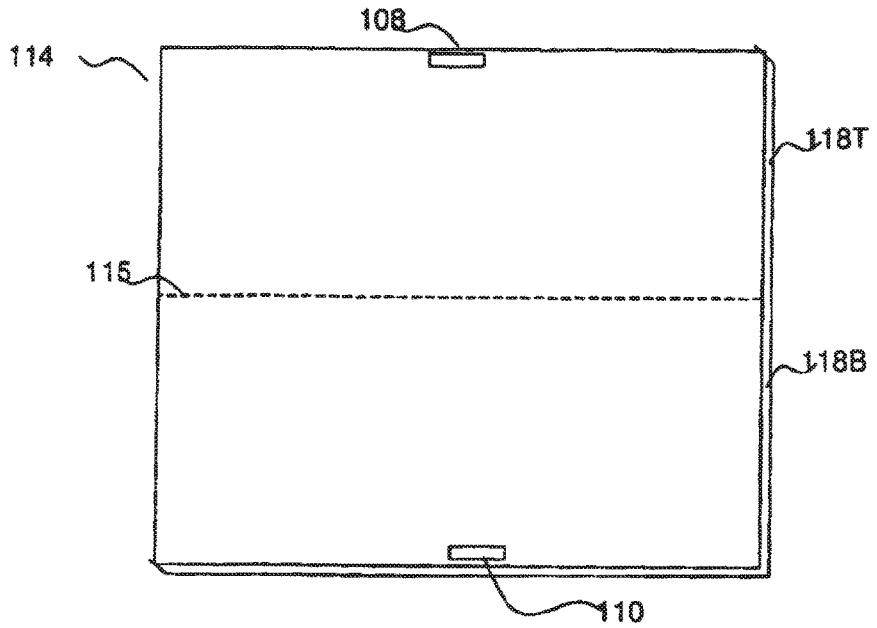
FIG. 2A is a front perspective view illustrating the construction of the first embodiment of the present invention.
Figure 2B:
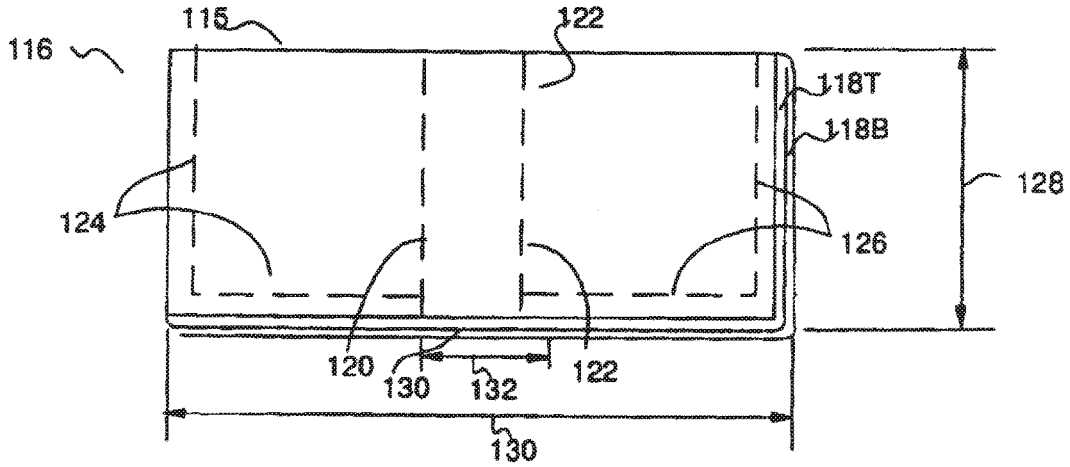
FIG. 2B is a front perspective view illustrating the construction of the first embodiment of the present invention.

FIGS. 2A and 2B illustrate how quilted purse stuffer 102 is constructed. Note that FIG. 1 includes markings 106 illustrating the seams of the quilted fabric. FIGS. 2A and 2B omit the seam markings. Referring to FIG. 2A, a small strip of a hook material 108 is attached to top center of a purse rectangular sheet 114 made of quilted fabric, positioned horizontally. A small strip of loop material 110 is attached to bottom center of purse rectangular sheet 114 positioned horizontally. Purse rectangular sheet 114 is divided into a rectangular sheet top half 118T and a rectangular sheet bottom half 118B by a horizontal purse fold line 115. Purse rectangular sheet 114 is enfolded in half along horizontal purse fold line 115 by folding rectangular sheet top half 118T forward and then down. A folded purse rectangular sheet 116 results from this fold as illustrated in FIG. 2B.

Figure 3A:
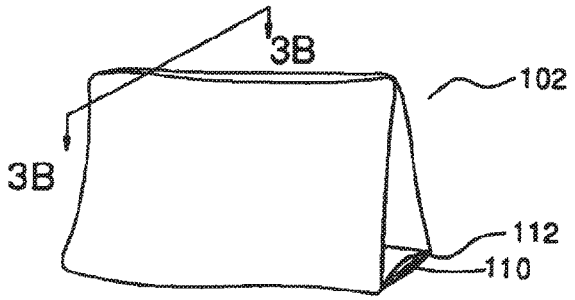
FIG. 3A is a perspective view of a quilted stuffer of the first embodiment of the present invention.

Referring now to FIG. 2B, a first purse stitched path 120 is stitched, and a second purse stitched path 122 is stitched, thereby creating the pocket 112 for sachet 104. Pocket 112 is not illustrated in FIG. 2B. Then a third purse stitched path 124 is stitched, and a fourth purse stitched path 126 is stitched, completing the construction of quilted purse stuffer 102. Quilted purse stuffer 102 is then shaped by folding along first purse stitched path 120 and second purse stitched path 122 to form a purse stuffer shape as illustrated in FIG. 3A. Sachet 104 may be added to pocket 112.

Purse stuffer 100 may be manufactured in a variety of sizes to accommodate purses and shoulder bags of various sizes. To give two examples, a medium size purse stuffer preferably has a length 130 of 24 inches (60.96 centimeters), a height 128 of 12 inches (30.48 centimeters) and pocket 112 having a pocket width 132 of 5 inches (12.7 centimeters). Sachet 104, in the medium sized example, is made of muslin, and has a length of 11 inches (27.94 centimeters) and a width of 4 inches (10.16 centimeters). A mini-sized purse has length 130 of 9.25 inches (23.49 centimeters) and height 128 of 5 inches (12.7 centimeters).

Figure 3B:
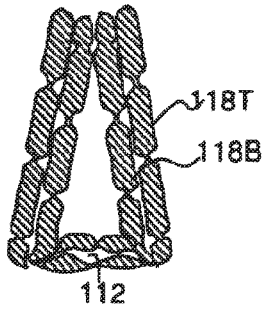
FIG. 3B is a sectional view of FIG. 3A taken along line 3B-3B.

FIG. 3B illustrates a sectional view of FIG. 3A illustrating rectangular sheet top half 118T of purse rectangular sheet 114, bottom half of purse rectangular sheet 118B, and pocket 112.

Purse stuffer 100, illustrated in FIG. 1, has the shape of a tent. However, purse stuffer 100 may be folded in alternate shapes such as being rolled into a tube or folded into rectangles to accommodate purses of different sizes. Sachet 104 may have an aromatic filler comprising a mixture of organic hulls and lavender. As an example, the filler may contain 2.5 ounces (70.87 grams) of hulls and 0.5 ounces (14.17 grams) of lavender. Alternately the filler may be comprised of hulls and cedar.

Figure 4:
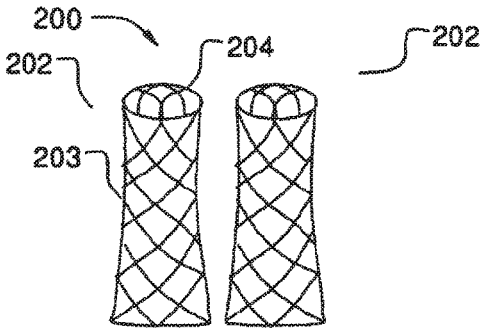
FIG. 4 is a perspective view of a pair of boot stuffers comprising a second embodiment of the present invention.

FIG. 4 is a perspective view of a second embodiment 200. Second embodiment 200 is comprised of a set of two boot stuffers 202. The boot stuffer 202 has the shape of a cylindrical shaft 203, cylindrical shaft 203 is flattened at as haft first end 208 with a cap 204 positioned at a shaft second end 209.

Figure 5:
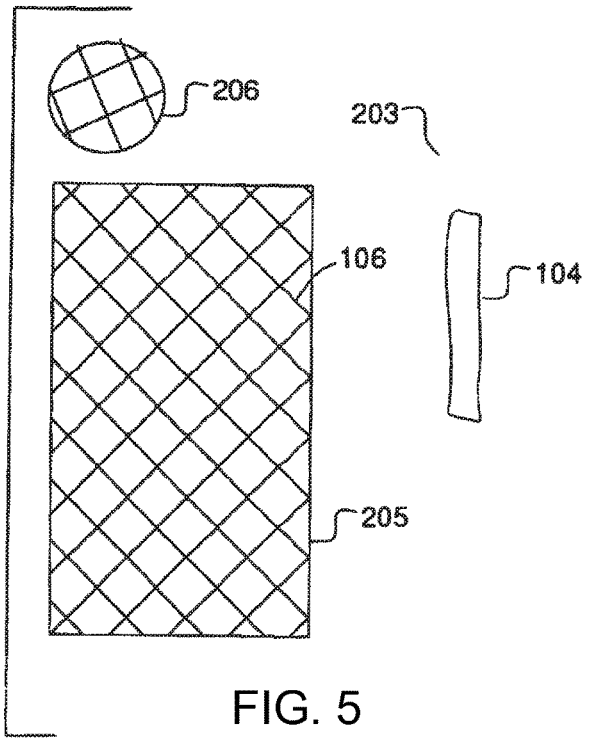
FIG. 5 illustrates the three components used to construct the second embodiment of the present invention.

Referring to FIG. 5, boot stuffer 202 of second embodiment 200 is constructed out of two components, a member comprised of two subcomponents; a boot stuffer rectangular subcomponent 205 having a substantially rectangular shape and a boot stuffer circular subcomponent 206 having a circular shape, and a second component comprised of a sachet 104. Both boot stuffer rectangular subcomponent 205 and boot stuffer circular subcomponent 206 are made out of a flexible, resilient fabric, preferably a quilted fabric such as a quilted polyester silk charmeuse.

FIGS. 6A through 6G illustrate the steps of constructing the boot stuffer 202 (illustrated in FIG. 4) out of boot stuffer rectangular subcomponent 205, boot stuffer circular subcomponent 206, and sachet 104. To construct boot stuffer 202, the following steps are performed. Note that FIG. 5 includes markings 106 illustrating the seams of the quilted fabric. FIGS. 6A through 6G omit seam markings.

Figure 6A:
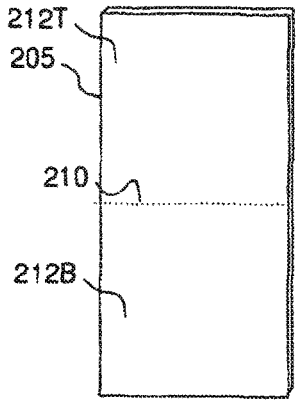
FIG. 6A illustrates, in part, the steps involved in constructing a boot stuffer according to the second embodiment of the present invention.
Figure 6B:
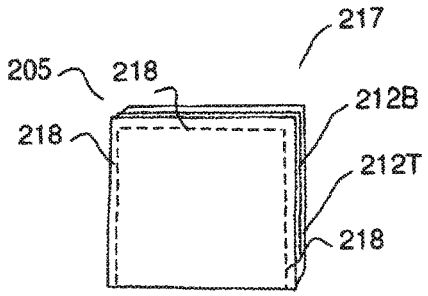
FIG. 6B illustrates, in part, the steps involved in constructing a boot stuffer according to the second embodiment of the present invention.

Referring to FIGS. 6A and 6B, boot stuffer rectangular subcomponent 205 is divided into a boot stuffer rectangular component first half 212T and a boot stuffer rectangular component second half 212B by a horizontal fold line 210. Boot stuffer rectangular component second half 212B is folded up so boot stuffer rectangular component second half 212B lies on top of boot stuffer rectangular component first half 212T.

Referring to FIG. 6B, boot stuffer rectangular component first half 212T and boot stuffer rectangular component second half 212B are stitched together along a first boot stitched path 218. The result is a folded rectangular sheet 217 that has been stitched together as illustrated.

Figure 6C:
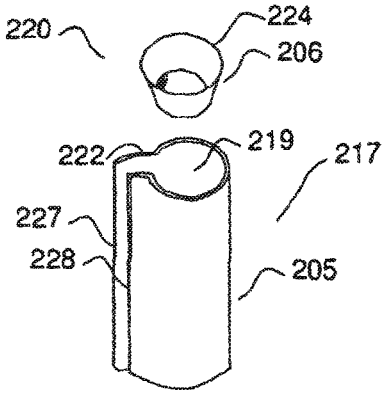
FIG. 6C illustrates, in part, the steps involved in constructing a boot stuffer according to the second embodiment of the present invention.

Referring now to FIG. 6C, folded rectangular sheet 217 is folded into a predominantly cylindrical shape forming a cylindrical portion 219 having a boot stuffer rectangular component first edge 227 and a boot stuffer rectangular component second edge 228. Boot stuffer circular subcomponent 206 is folded into an inverted bowl shape 220 and placed over cylindrical portion 219 of folded rectangular sheet 217.

Figure 6D:
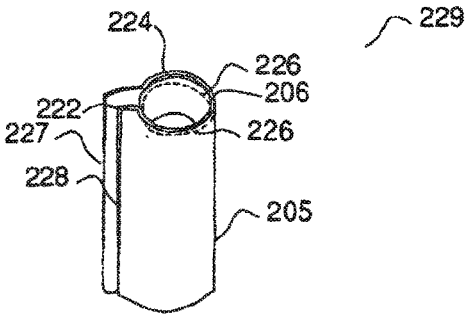
FIG. 6D illustrates, in part, the steps involved in constructing a boot stuffer according to the second embodiment of the present invention.

Referring now to FIGS. 6C and 6D, boot stuffer circular subcomponent 206 is inserted into cylindrical portion 219 of folded rectangular sheet 217 so that boot upper edge 222 of boot cylindrical shape coincides with cap upper edge 224 of boot stuffer circular subcomponent 206.

Referring to FIG. 6D, boot stuffer circular subcomponent 206, and boot stuffer rectangular subcomponent 205 are stitched together along a second boot stitched path 226. The result is a boot with cap 229.

Figure 6E:
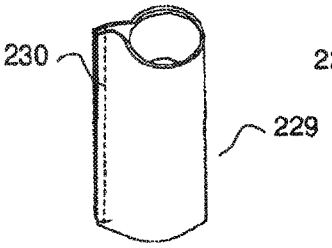
FIG. 6E illustrates, in part, the steps involved in constructing a boot stuffer according to the second embodiment of the present invention.

Referring to FIG. 6E, boot stuffer rectangular component first edge 227 and boot stuffer rectangular component second edge 228 of boot with cap 229 are stitched together along a third boot stitched path 230.

Figure 6F:
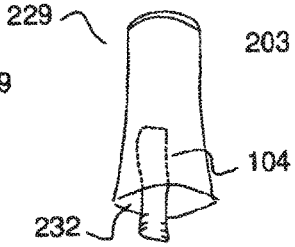
FIG. 6F illustrates, in part, the steps involved in constructing a boot stuffer according to the second embodiment of the present invention.

Referring now to FIG. 6F, boot with cap 229 is turned inside out, then sachet 104 is inserted into bottom opening 232 of boot with cap 229.

Figure 6G:
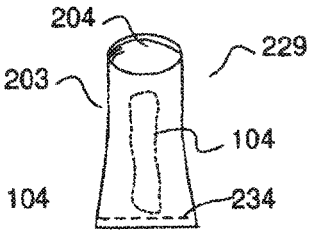
FIG. 6G illustrates, in part, the steps involved in constructing a boot stuffer according to the second embodiment of the present invention.

Referring now to FIG. 6G, bottom opening 232 is closed and stitched together along a fourth boot stitched path 234. The final shape of the second embodiment has a cylindrical shaft 203 flattened at a shaft first end 208 with a cap 204 located at shaft second end 209. This completes the construction of boot stuffer 202. Alternately, bottom opening 232 may be secured with a hook and loop pair or a zipper so that sachet 104 may be removed.

Boot stuffer 202 may come in various sizes to accommodate boots of various sizes. Construction details are the same; only the dimensions of the components change. For example, boot stuffer 202 may have outside diameter of 4 inches (10.16 centimeters) at the top and 3 inches (7.62 centimeters) at the bottom, and a length of 12 inches (30.48 centimeters). The sachet may have a length of 5 inches (12.7 centimeters) and a width of 6 inches (15.24 centimeters), and uses a filling of two parts hull and one part cedar. Alternate methods of construction are also considered within the present invention. For example, boot stuffer may have a length larger or smaller than 12 inches (30.48 centimeters). Boot stuffer rectangular subcomponent 205 may not be folded over, but may be made of a thick quilted fabric that is given the shape as illustrated in FIG. 4, but constructed in a different manner than what is illustrated in FIGS. 6A through 6G. The fabric used in the construction may use a thick resilient fabric that is not quilted.

Figure 7:
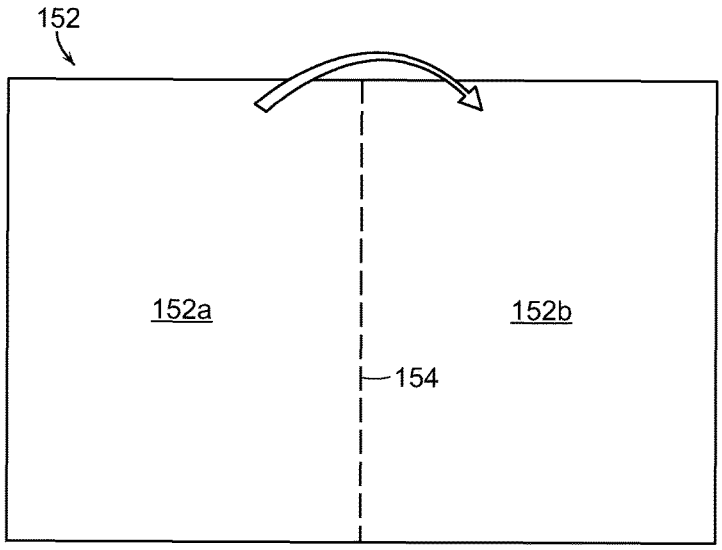
FIG. 7 illustrates, in part, the steps involved in constructing a purse stuffer according to the third and fourth embodiments of the present invention.
Figure 8:
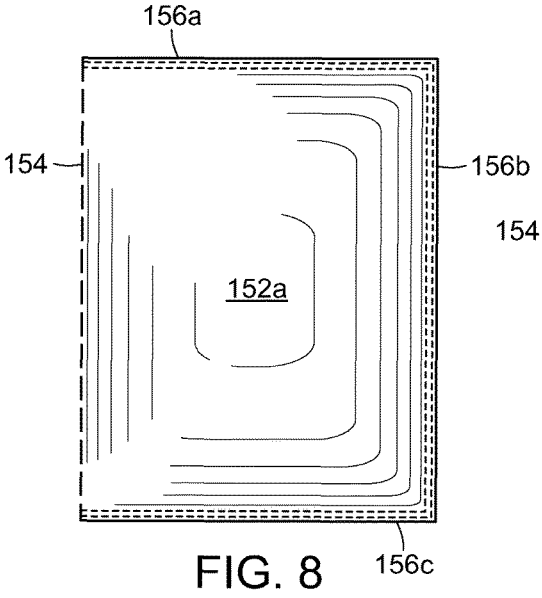
FIG. 8 illustrates, in part, the steps involved in constructing a purse stuffer according to the third and fourth embodiments of the present invention.
Figure 9:
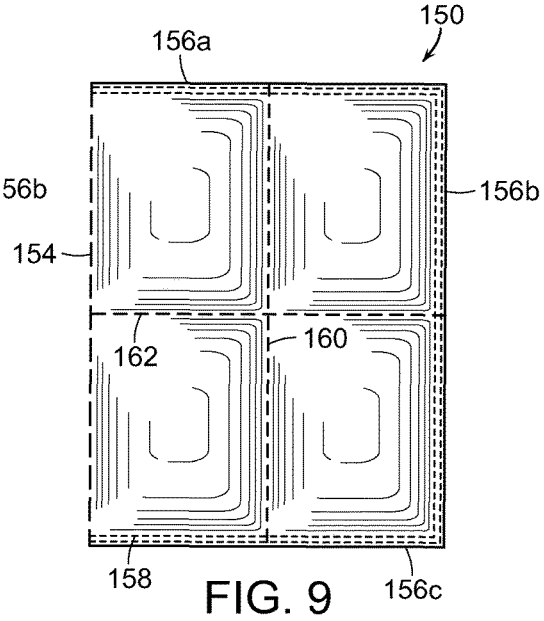
FIG. 9 illustrates, in part, the steps involved in constructing a purse stuffer according to the third embodiment of the present invention.

FIGS. 7 through 15 illustrate steps involved in constructing and using purse stuffers 150 according to third and fourth embodiments of the present invention. As shown in FIG. 7, a relatively large, rectangular sheet of quilted fabric 152 is laid out. This sheet of quilted fabric 152 is then folded along a generally central line 154 so as to form overlapping sections 152*a* and 152*b* as shown in FIG. 8. Overlapping sections 152*a* and 152*b* are preferably perfectly overlapping such that one completely eclipses the other.

The three exterior edges 156*a*, 156*b*, 156*c* of the overlapping sections 152*a* and 152*b* are then secured by relatively heavy stitching 158 so as to secure the overlapping sections 152*a* and 152*b* together. The heavy stitching 158 on the edges 156*a*, 156*b*, 156*c* may be exterior exposed stitching or it may be interior hidden stitching depending upon the user's preference. This folding and stitching of the overlapping sections 152*a* and 152*b* of the quilted fabric 152 creates an interior, closed pocket and provides a padded quilted material for the purse stuffers 150 that has more volume and padding than a single sheet of quilted fabric.

Figure 10:
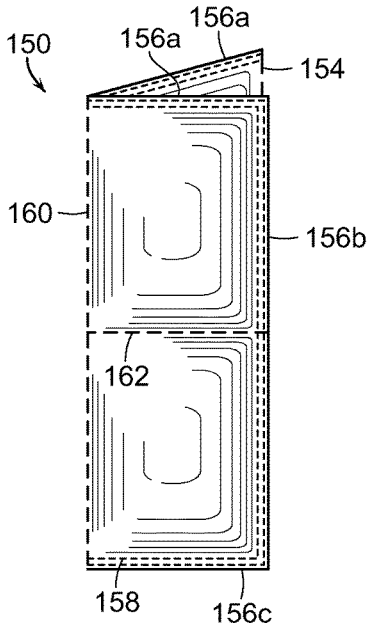
FIG. 10 illustrates, in part, the steps involved in using a purse stuffer according to the third embodiment of the present invention.
Figure 11:
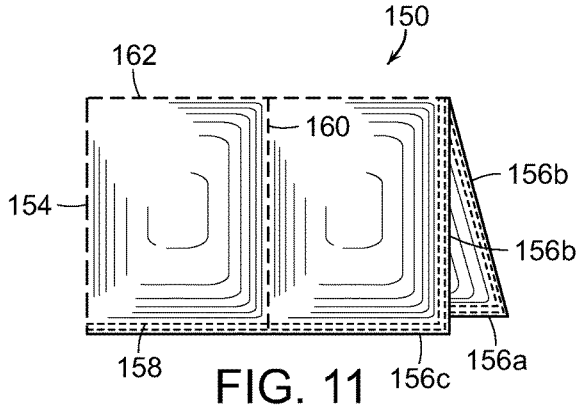
FIG. 11 illustrates, in part, the steps involved in using a purse stuffer according to the third embodiment of the present invention.
Figure 12:
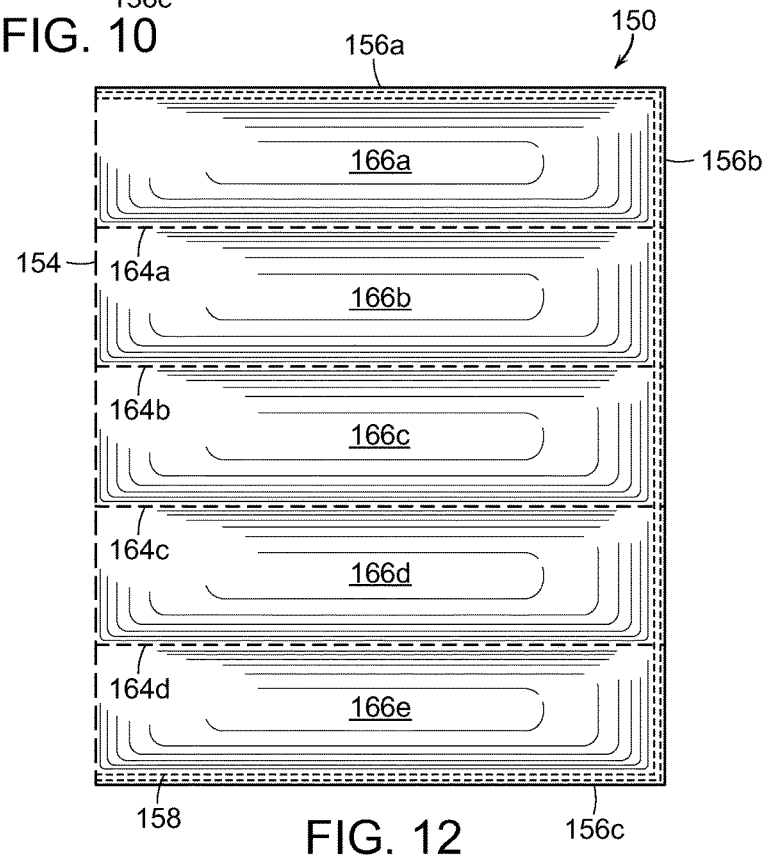
FIG. 12 illustrates, in part, the steps involved in constructing a purse stuffer according to the fourth embodiment of the present invention.

In the third preferred embodiment (FIG. 9), folding stitch seams 160 and 162 are preferably stitched along the midlines of each major dimension, e.g., length and width, of the overlapping sections 152*a* and 152*b*. The folding stitch seams 160 and 162 facilitate folding of the purse stuffer into different shapes or dimensions that are more likely to fill-up and adequately stuff purses of different shapes and sizes, such as bags, clutches or micro purses. FIG. 10 shows one fold where the stuffer 150 is folded along folding stitch seam 160 so as to create an elongated rectangle shape useable to stuff clutch bags or similar elongated, shallow purses. FIG. 11 shows a second fold where the stuffer 150 is folded along folding stitch seam 162 so as to create a shortened rectangular shape useable to stuff micro purses or similarly shaped purses.

Figure 13:
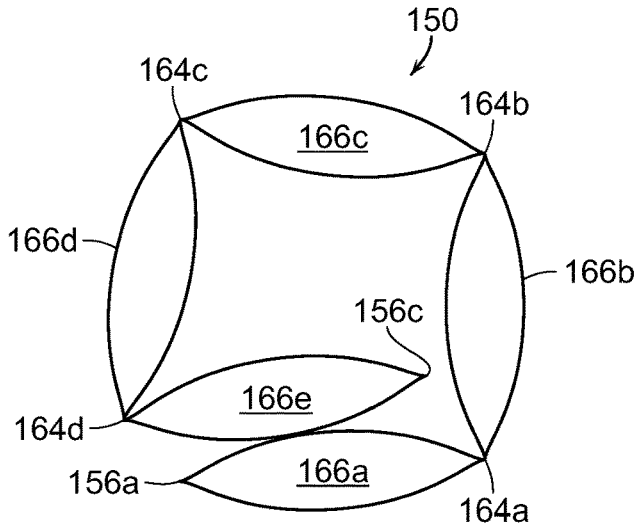
FIG. 13 illustrates, in part, the steps involved in using a purse stuffer according to the fourth embodiment of the present invention.
Figure 14:
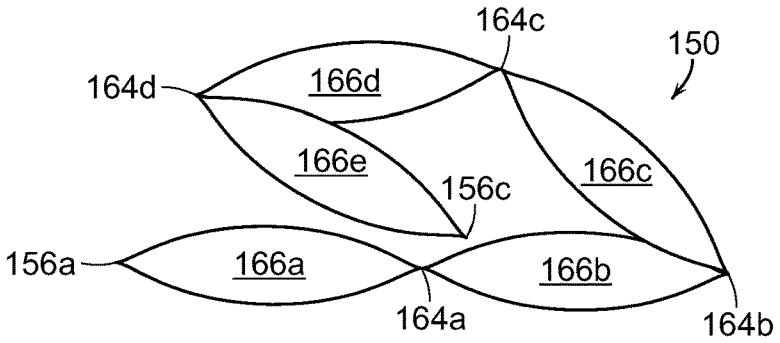
FIG. 14 illustrates, in part, the steps involved in using a purse stuffer according to the fourth embodiment of the present invention.
Figure 15:
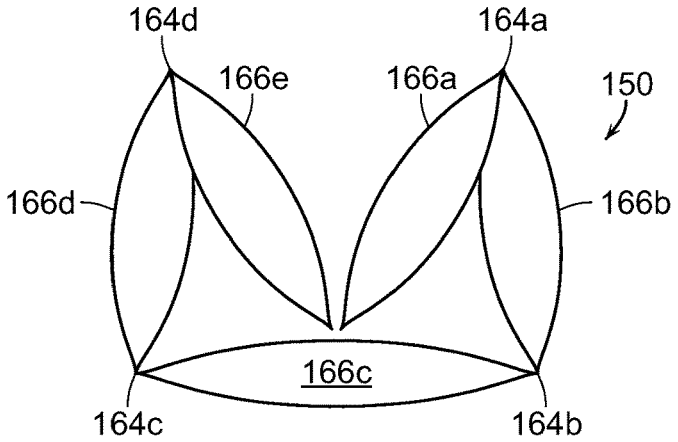
FIG. 15 illustrates, in part, the steps involved in using a purse stuffer according to the fourth embodiment of the present invention.

In the fourth preferred embodiment (FIG. 12), folding stitch seams 164*a*, 164*b*, 164*c*, and 164*d* are preferably stitched across the width of the overlapping sections 152*a* and 152*b*. The folding stitch seams 164*a*, 164*b*, 164*c*, 164*d* are parallel and equally spaced along the length of the overlapping sections 152*a* and 152*b*. In this way the folding stitch seams 164*a*, 164*b*, 164*c*, and 164*d* form equal sized folding sections 166*a*, 166*b*, 166*c*, 166*d*, and 166*e*, each having a generally pointed oval cross-sectional shape. These folding sections 166*a*, 166*b*, 166*c*, 166*d*, and 166*e* of the stuffer 150 may folded and overlapped in various shapes as depicted in FIGS. 13, 14 and 15. The folded shapes of the purse stuffer 150 in FIGS. 13, 14 and 15 may be used to stuff larger, over-sized bags that have more volume to fill.

The embodiments of the present invention are to be considered as only illustrative of the present invention and not a limitation of the scope of the present invention. Various permutations, combinations, variations and extensions of these embodiments are considered to fall within the scope of the present invention. Therefore, the scope of this invention should be determined with respect to the claims and not just by the embodiments presented.

The purse and boot stuffer described herein has a number of particular features that should preferably be employed in combination, although each is useful separately without departure from the scope and spirit of the invention. Although several preferred embodiments have been described in detail for purposes of illustration, various modifications may be made without departing from the scope and spirit of the invention. Accordingly, the invention is not to be limited, except as by the appended claims.

What is claimed is:

1. A stuffer for filling an internal cavity of a bag having a preferred shape, the stuffer comprising:

a generally rectangular sheet of quilted fabric, wherein the quilted fabric sheet is folded in half along a mid-line of the generally rectangular shape so as to form overlapping upper and lower sections, wherein adjacent edges of the upper and lower sections are stitched together so as to form a generally rectangular sheet of double quilted fabric enclosing an interior pocket;

a plurality of fold stitch lines across the sheet of double quilted fabric so as to join the upper and lower sections through the interior pocket; and wherein the sheet of double quilted fabric is configured to approximate the preferred shape of the internal cavity of the bag; and wherein the sheet of double quilted fabric is foldable along one or more of the fold stitch lines to more closely approximate the preferred shape of the internal cavity of the bag.

2. The stuffer of claim 1, wherein the interior pocket of the double quilted fabric contains apparel padding material.

3. The stuffer of claim 1, wherein the fold stitch lines consist of a first fold stitch line and a second fold stitch line that are arranged orthogonally with respect to one another.

4. The stuffer of claim 3, wherein each of the first fold stitch line and the second fold stitch line are separately arranged orthogonally to one of the adjacent edges of the upper and lower sections.

5. The stuffer of claim 4, wherein the first fold stitch line is approximately at a mid-point of a length of the sheet of double quilted fabric and the second fold stitch line is approximately at a mid-point of a width of the sheet of double quilted fabric.

6. The stuffer of claim 1, wherein the fold stitch lines comprise at least four fold stitch lines that are arranged parallel with respect to one another and to at least one of the adjacent edges of the upper and lower sections.

7. The stuffer of claim 6, wherein the four fold stitch lines divide the sheet of double quilted fabric into five parallel padding sections, wherein each padding section has a generally pointed oval cross-sectional shape.

8. The stuffer of claim 7, wherein one or more of the padding sections are configured to overlap or abut when the sheet of double quilted fabric is folded alone one or more of the fold stitch lines.

9. A stuffer for filling an internal cavity of a bag having a preferred shape, the stuffer comprising:

a generally rectangular sheet of quilted fabric, wherein the quilted fabric sheet is folded in half along a mid-line of the generally rectangular shape so as to form overlapping upper and lower sections, wherein adjacent edges of the upper and lower sections are stitched together so as to form a generally rectangular sheet of double quilted fabric enclosing an interior pocket containing apparel padding material;

a first fold stitch line and a second fold stitch line arranged orthogonally with respect to one another across the sheet of double quilted fabric so as to join the upper and lower sections through the interior pocket; and wherein the sheet of double quilted fabric is configured to approximate the preferred shape of the internal cavity of the bag; and wherein the sheet of double quilted fabric is foldable along one or more of the fold stitch lines to more closely approximate the preferred shape of the internal cavity of the bag.

10. The stuffer of claim 9, wherein each of the first fold stitch line and the second fold stitch line are separately arranged orthogonally to one of the adjacent edges of the upper and lower sections.

11. The stuffer of claim 10, wherein the first fold stitch line is approximately at a mid-point of a length of the sheet of double quilted fabric and the second fold stitch line is approximately at a mid-point of a width of the sheet of double quilted fabric.

12. A stuffer for filling an internal cavity of a bag having a preferred shape, the stuffer comprising:

a generally rectangular sheet of quilted fabric, wherein the quilted fabric sheet is folded in half along a mid-line of the generally rectangular shape so as to form overlapping upper and lower sections, wherein adjacent edges of the upper and lower sections are stitched together so as to form a generally rectangular sheet of double quilted fabric enclosing an interior pocket containing apparel padding material;

at least four fold stitch lines arranged parallel with respect to one another and at least one of the adjacent edges of the upper and lower sections across the sheet of double quilted fabric so as to join the upper and lower sections through the interior pocket; and wherein the sheet double quilted fabric is configured to approximate the preferred shape of the internal cavity of the bag; and wherein the sheet of double quilted fabric is foldable along one or more of the fold stitch lines to more closely approximate the preferred shape of the internal cavity of the bag.

13. The stuffer of claim 12, wherein the four fold stitch lines divide the sheet of double quilted fabric into five parallel padding sections, wherein each padding section has a generally pointed oval cross-sectional shape.

14. The stuffer of claim 13, wherein one or more of the padding sections are configured to overlap or abut when the sheet of double quilted fabric is folded alone one or more of the fold stitch lines.

* * * * *